US010283867B2

(12) United States Patent
Khan et al.

(10) Patent No.: US 10,283,867 B2
(45) Date of Patent: May 7, 2019

(54) SQUARE SHAPED MULTI-SLOTTED 2.45 GHZ WEARABLE ANTENNA

(71) Applicant: COMSATS Institute of Information Technology, Wah (PK)

(72) Inventors: Muhammad Toaha Raza Khan, Wah (PK); Nadia Nawaz Qadri, Wah (PK); Hassan Iftikhar, Wah (PK)

(73) Assignee: COMSATS Institute of Information Technology (PK)

( * ) Notice: Subject to any disclaimer, the term of this patent is extended or adjusted under 35 U.S.C. 154(b) by 144 days.

(21) Appl. No.: 15/626,536

(22) Filed: Jun. 19, 2017

(65) Prior Publication Data

US 2017/0365927 A1 Dec. 21, 2017

(30) Foreign Application Priority Data

Jun. 20, 2016 (PK) ..... 370/2016

(51) Int. Cl.

| | |
|---|---|
| ***H01Q 1/32*** | (2006.01) |
| ***H01Q 9/04*** | (2006.01) |
| ***H01Q 1/27*** | (2006.01) |
| ***H01Q 1/24*** | (2006.01) |

(52) U.S. Cl.
CPC ..... *H01Q 9/0407* (2013.01); *H01Q 1/245* (2013.01); *H01Q 1/273* (2013.01)

(58) Field of Classification Search
CPC ..... H01G 1/38; H01G 9/0407
See application file for complete search history.

(56) References Cited

U.S. PATENT DOCUMENTS

2011/0006950 A1* 1/2011 Park ..... H01Q 9/0407 343/700 MS
2016/0079676 A1* 3/2016 Chuang ..... H01Q 9/0407 343/770

* cited by examiner

*Primary Examiner* — Graham P Smith
(74) *Attorney, Agent, or Firm* — H.C. Park & Associates, PLC

(57) ABSTRACT

A microstrip antenna including: a substrate; a radiating slotted patch; a square plate; and a coaxial feed, wherein the coaxial feed further comprises an inner central conducting pin; wherein the substrate is sandwiched between the radiating slotted patch and the square plate, and wherein the coaxial feed is connected to the square plate, and the inner central conducting pin of coaxial feed passes through the substrate and is connected to the radiating slotted patch.

18 Claims, 2 Drawing Sheets

SQUARE SHAPED MULTI-SLOTTED 2.45 GHZ WEARABLE ANTENNA

CROSS-REFERENCE TO RELATED APPLICATION

This application claims priority from and the benefit of Pakistani Provisional Patent Application No. 370/2016, filed on Jun. 20, 2016, which is hereby incorporated by reference for all purposes as if fully set forth herein.

BACKGROUND

Field

The invention is about a wearable microscrip patch antenna, more specifically a slotted antenna working in ISM band.

Discussion of the Background

Antenna is a vital component for wireless communication. In modern era antennas is considered to have an important role in cellular phones, auto-mobiles, hand held devices and satellites etc. Advances in wireless communication and with continuous miniaturization of electronic devices have introduced Body Area Networks (BANs), an emerging new technology for many applications. Wearable antennas play a major role in BANs. Modern wearable antennas are normally considered to be light weight and are more efficient especially microstrip antennas with very light profile working at microwave frequencies have found many applications in BANs.

Several microstrip patch antennas are available in the market and are operated in ISM band, however majority of these do not fully comply with the requirements of wearable antennas. Therefore there is a need to design and develop an antenna; which is smart to wear by selecting a very light weight substrate and proper slotting to reduce average Specific Absorption Rate (SAR).

SUMMARY

According to exemplary embodiments, a microstrip antenna including: a substrate; a radiating slotted patch; a square plate; and a coaxial feed, wherein the coaxial feed further comprises an inner central conducting pin; wherein the substrate is sandwiched between the radiating slotted patch and the square plate, and wherein the coaxial feed is connected to the square plate and, while passing through the substrate, the inner central conducting pin of coaxial feed is connected to the radiating slotted patch.

The size of the substrate may be 73.80×73.80 mm.

The substrate may be made of pure polyester.

The radiating slotted patch may include a upper left square slot, a upper right square slot, a lower left square slot, a lower right square slot placed on each corner of the radiating slotted patch; a first rectangular slot, a second rectangular slot and a third rectangular slot; and four radiating edges.

The size of the upper left square slot may be 8.20×8.20 mm.

The size of the upper right square slot may be 7.38×7.38 mm.

The size of the lower left square slot may be 7.38×7.38 mm.

The size of the lower right square slot is 8.20×8.20 mm.

The first rectangular slot may be located between the upper left square slot and lower left square slot.

The second rectangular slot may be located between the upper left square slot and upper right square slot.

The third rectangular slot may be located between the upper right square slot and lower right square slot.

The size of each rectangular slot may be 6.91×1.53 mm.

The four radiating edges may be L-shaped and located at four vertices of the radiating slotted patch.

Each of the radiating edges may have an area of 15.87 $mm^2$.

The radiating slotted patch may be made of copper.

The size of the square plate may be 73.80×73.80 mm.

The antenna may be operated at a frequency of 2.4 GHz.

DETAILED DESCRIPTION OF THE ILLUSTRATED EMBODIMENTS

Figure 1:
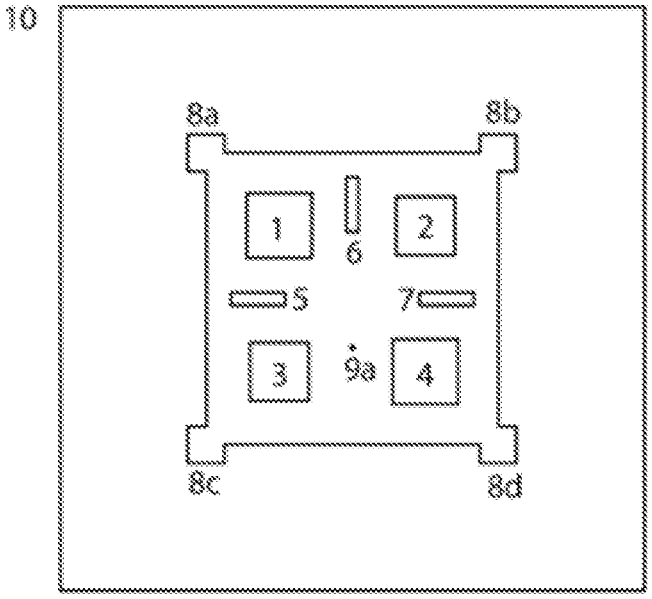
FIG. 1 shows the design of a multi-slotted 2.45 GHz wearable antenna, according to an exemplary embodiment.
Figure 2:
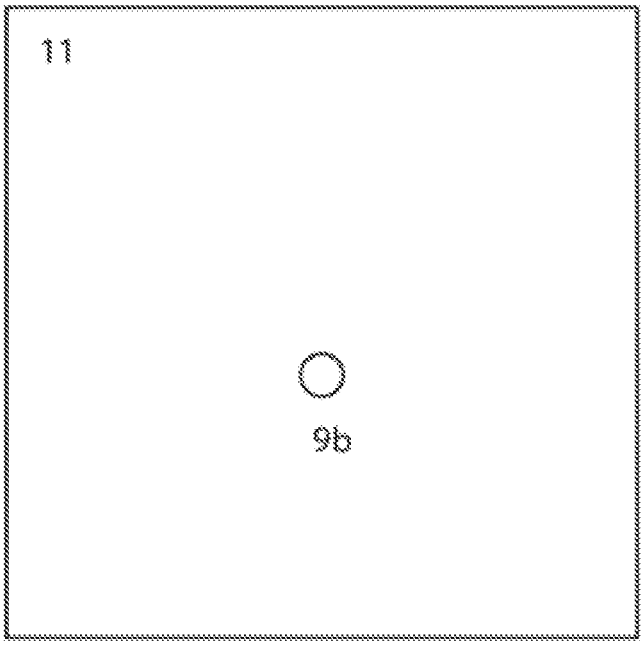
FIG. 2 shows the ground plan and the feed pin hole, according to an exemplary embodiment.
Figure 3:
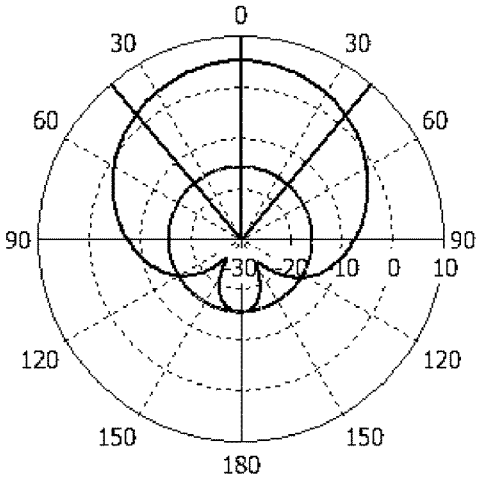
FIG. 3 shows the 2D radiation pattern, according to an exemplary embodiment.
Figure 4:
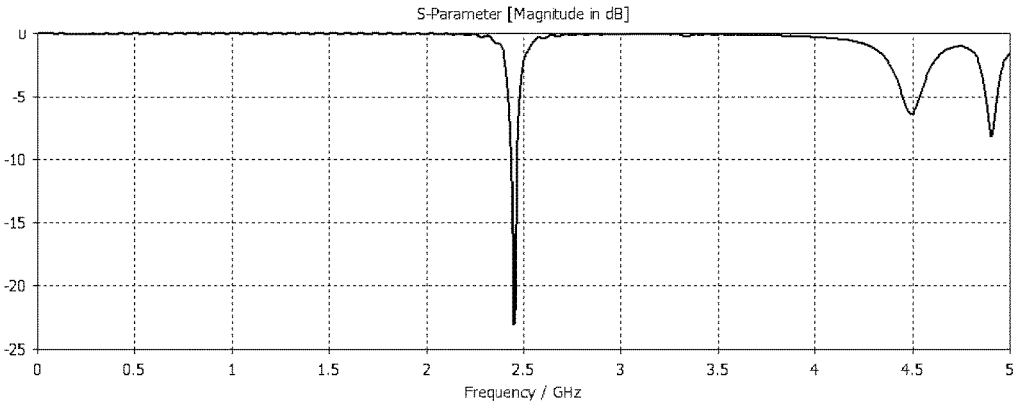
FIG. 4 shows the radiation frequency of the antenna, according to an exemplary embodiment.

FIG. 1 shows the design of a multi-slotted 2.45 GHz wearable antenna, according to an exemplary embodiment. FIG. 2 shows the ground plan and the feed pin hole, according to an exemplary embodiment. The exemplary embodiment describes a multi-slotted 2.45 GHz wearable antenna aims to operate in ISM band with high gain. The exemplary embodiments implement a slotted model which provides a good radiation pattern, low loss, easy to integrate and simple structure characteristics. FIG. 3 shows the 2D radiation pattern, according to an exemplary embodiment, and FIG. 4 shows the radiation frequency of the antenna, according to an exemplary embodiment.

A multi slotted 2.45 GHz wearable antenna according to an exemplary embodiment, includes a light weight substrate 10, a radiating patch 8 showing sharp edges, a square shaped copper ground floor 11 having same size as microstrip substrate. The patch contains many radiating slots, which are added for better radiation, to meet ISM band requirements, and to reduce SAR. All slots are on the patch, the Upper Right square slot 2, the upper left square slot 1, and between the two upper square slots a rectangular 6 small slot. There are two lower square slots lower right slot 4 and Lower Left slot 3. A rectangular slot 7 exists between the upper right square slot 2 and lower right square slot 4. Another rectangular 5 slot on the patch between the upper left slot 1 and a lower left slot 3. All the slots are on the same patch. Four L-shape radiating edges (8*a*, 8*b*, 8*c*, and 8*d*) at the upper left, upper right, lower left, and lower right vertices of the patch respectively as shown in FIG. 1. These are the sharp radiating edges. The coaxial feed (including inner central conducting pin of coaxial feed 9*a* and the external conductor of the coaxial cable 9*b*) of antenna is settled on the front of substrate, where at the inner central conducting pin of coaxial feed 9*a* the patch is connected with the central conductor of feed that passes through the substrate and coper ground plate is connected with the external conductor of the coaxial cable 9*b*.

The microstrip substrate is made of polyester. According to an exemplary embodiment, the microstrip substrate 10 is a 73.80×73.80 $mm^2$ square, the thickness of the microstrip substrate is 1 mm. The patch 8 is on the one front side of substrate. The patch 8 is on the one front side of substrate. The substrate has two sides, on one size has a ground plate 11 and on the front side has a patch of area 1361.61 $mm^2$ 8. The dimensions of the square patch 8 are 36.90×36.90 $mm^2$. The patch 8 contains slots, the upper right square slot 2 is 7.38×7.38 $mm^2$, the upper left square slot 1 of 8.20×8.20 $mm^2$, the lower right slot 4 on the patch have the same size as the upper left 1 square slot i.e. 7.38×7.38 $mm^2$. The lower left square slot 3 is same in length and width as the upper right 2 square slot i.e. 8.20×8.20 $mm^2$. The rectangular slot 6 of length and width 6.91×1.53 $mm^2$ exists between the upper right 2 square slot and upper left square slot 1, a same size rectangular slot 7 of length and width 6.91×1.53 $mm^2$ is present between the upper right slot 2 and lower right slot 4, another rectangular slot 5 between upper left slot 1 and lower left slot 3. On the upper left vertex there is L-shape radiating edge 8*a* of area 15.87 $mm^2$. Another L-shape radiating edge of area 15.87 $mm^2$ 8*b* is present in the upper right vertex. On the lower left vertex of the patch there is another L-shape radiating edge 8*c* of area 15.87 $mm^2$. L-shape radiating edge 8*d* of area 15.87 $mm^2$ present at the lower right vertex of the radiating patch. The patch is connected with a line 9 of radius 0.5 mm to the coaxial feed. The ground plate 11 at the floor of the substrate is 73.80×73.80 $mm^2$, the thickness of the ground copper sheet is 0.05 mm.

What is claimed is:

1. A microstrip antenna, comprising:

a substrate;

a radiating slotted patch;

a square plate; and a coaxial feed, wherein the coaxial feed comprises an inner central conducting pin;

wherein the substrate is sandwiched between the radiating slotted patch and the square plate, and wherein the coaxial feed is connected to the square plate, and the inner central conducting pin of coaxial feed passes through the substrate and is connected to the radiating slotted patch, wherein the radiating slotted patch comprises a upper left square slot, a upper right square slot, a lower left square slot, a lower right square slot placed on each corner of the radiating slotted patch, a first rectangular slot, a second rectangular slot and a third rectangular slot, and four radiating edges.

2. The antenna of claim 1, wherein the size of the substrate is 73.80 mm×73.80 mm.

3. The antenna of claim 1, wherein the substrate comprises pure polyester.

4. The antenna of claim 1, wherein the size of the upper left square slot is 8.20 mm×8.20 mm.

5. The antenna of claim 1, wherein the size of the upper right square slot is 7.38 mm×7.38 mm.

6. The antenna of claim 1, wherein the size of the lower left square slot is 7.38 mm×7.38 mm.

7. The antenna of claim 1, wherein the size of the lower right square slot is 8.20 mm×8.20 mm.

8. The antenna of claim 1, wherein the first rectangular slot is located between the upper left square slot and lower left square slot.

9. The antenna of claim 1, wherein the second rectangular slot is located between the upper left square slot and upper right square slot.

10. The antenna of claim 1, wherein the third rectangular slot is located between the upper right square slot and lower right square slot.

11. The antenna of claim 1, wherein the size of each rectangular slot is 6.91 mm×1.53 mm.

12. The antenna of claim 1, wherein the four radiating edges are L-shaped and located at four vertices of the radiating slotted patch.

13. The antenna of claim 1, wherein each radiating edge has an area of 15.87 $mm^2$.

14. The antenna of claim 1, wherein the radiating slotted patch comprises copper.

15. The antenna of claim 1, wherein the square plate comprises copper.

16. The antenna of claim 1, wherein the size of the square plate is 73.80 mm×73.80 mm.

17. The antenna of claim 1, which operates at a frequency of 2.4 GHz.

18. The antenna of claim 1, wherein the antenna is configured to be worn.

* * * * *